US010895074B2

(12) United States Patent
Madison

(10) Patent No.: US 10,895,074 B2
(45) Date of Patent: Jan. 19, 2021

(54) INTERLOCKING BLOCKS FOR MODULAR STRUCTURES

(71) Applicant: John Mark Isaac Madison, Ann Arbor, MI (US)

(72) Inventor: John Mark Isaac Madison, Ann Arbor, MI (US)

(73) Assignee: John Mark Isaac Madison, Ann Arbor, MI (US)

( * ) Notice: Subject to any disclaimer, the term of this patent is extended or adjusted under 35 U.S.C. 154(b) by 0 days.

(21) Appl. No.: 16/277,286

(22) Filed: Feb. 15, 2019

(65) Prior Publication Data

US 2020/0263427 A1 Aug. 20, 2020

(51) Int. Cl.

| | |
|---|---|
| ***E04B 5/00*** | (2006.01) |
| ***E04B 1/04*** | (2006.01) |
| ***E04B 1/12*** | (2006.01) |
| ***E04B 1/10*** | (2006.01) |
| ***E04B 1/08*** | (2006.01) |

(52) U.S. Cl.

CPC ..... *E04C 1/24* (2013.01); *E04B 1/043* (2013.01); *E04B 1/08* (2013.01); *E04B 1/10* (2013.01); *E04B 1/12* (2013.01)

(58) Field of Classification Search

CPC ..... E04C 1/24; A63H 33/101; A63H 33/062; A63H 33/107; A63H 33/12; Y10T 403/342; Y10T 403/10; F16B 12/24; F16B 12/26; E04B 1/043; E04B 1/12; E04B 1/10; E04B 1/08

USPC ..... 52/574, 582.1, 592.1, 654.1

See application file for complete search history.

(56) References Cited

U.S. PATENT DOCUMENTS

| | | | | |
|---|---|---|---|---|
| 2,909,867 | A * | 10/1959 | Hobson | A63H 33/065 446/116 |
| 3,264,021 | A | 8/1966 | Artman | |
| 3,286,391 | A | 11/1966 | Mengeringhausen | |
| 4,050,184 | A | 9/1977 | Chiari | |
| 4,129,975 | A | 12/1978 | Gabriel | |
| 4,231,198 | A * | 11/1980 | Augier | E04B 1/21 403/171 |
| 4,365,454 | A | 12/1982 | Davis | |
| 4,516,375 | A * | 5/1985 | Pagano | E04C 1/40 52/581 |
| 5,137,486 | A | 8/1992 | Glickman | |
| 5,238,438 | A | 8/1993 | Glickman | |

(Continued)

*Primary Examiner* — Theodore V Adamos

(57) ABSTRACT

The modular structures and methods for making and using the same are disclosed herein. The modular device can include one or more support panels, one or more connecting members (also referred to as "bones") and one or more fasteners. Support panels can be connected together in groups of two or more using the fastener, to provide a frame for the connection to connecting members. The connecting members connect between the support panels, such that groups of support panels can be connected together and extended upon one another. The connecting members connect at receiving ports in the support panels, which receive and affix at least a portion of the connecting member. The support panels generally form the frame of the modular structures, while connecting members connect between the support panels. The interlocking and alternating elements allow for the variety of structures and flexibility described herein.

18 Claims, 6 Drawing Sheets

(56) References Cited

U.S. PATENT DOCUMENTS

| | | | | |
|---|---|---|---|---|
| 5,826,394 | A * | 10/1998 | Barton, Jr. | A63H 33/044 52/592.1 |
| 5,871,384 | A * | 2/1999 | Kichijo | A63H 33/062 446/112 |
| 6,176,757 | B1 * | 1/2001 | Lin | A63H 33/101 446/102 |
| 6,450,853 | B1 | 9/2002 | Larws | |
| 6,736,691 | B1 | 5/2004 | Bach | |
| 8,109,803 | B2 * | 2/2012 | Kichijo | A63H 33/108 428/33 |
| 8,403,723 | B1 | 3/2013 | Haner | |
| 9,114,325 | B1 | 8/2015 | Sternhill | |
| 2002/0065016 | A1 | 5/2002 | Huang | |
| 2004/0198141 | A1 | 10/2004 | Buhrman | |
| 2006/0080928 | A1 * | 4/2006 | Kichijo | A63H 33/101 52/596 |
| 2006/0276100 | A1 | 12/2006 | Glickman | |
| 2010/0210173 | A1 * | 8/2010 | Maggiore | A63H 33/062 446/125 |
| 2011/0028064 | A1 * | 2/2011 | Christensen | A63H 33/101 446/120 |
| 2013/0012098 | A1 * | 1/2013 | Meys | A63H 33/062 446/85 |
| 2013/0195547 | A1 | 8/2013 | De Wilde | |
| 2013/0312357 | A1 | 11/2013 | Lin | |
| 2015/0259910 | A1 * | 9/2015 | Montiel Reyes | A63H 33/10 52/604 |
| 2018/0061280 | A1 | 3/2018 | Miyashita | |
| 2018/0233856 | A1 * | 8/2018 | Brandwijk | H01R 13/631 |

* cited by examiner

INTERLOCKING BLOCKS FOR MODULAR STRUCTURES

TECHNICAL FIELD

The subject matter described herein generally relates to building devices and, more particularly, modular construction devices.

BACKGROUND

Indoor furniture and structures, such as tables, chairs, subdividing walls, and others, are used in numerous homes and offices across the country. These devices are constructed in a variety of ways and from numerous materials. Further, these devices generally include significant construction costs. As well, these devices can require significant transportation costs to move from the site of manufacture to the home or the office. More recently, pre-manufactured versions of these devices are shipped to the home or office to be built or installed by the owner or user. Shipments of pre-manufactured versions can help reduce the cost of transit. However, pre-manufactured versions of these devices generally weigh the same are made from the same materials and requires similar construction costs.

SUMMARY

Disclosed herein is a modular building device for use in indoor furniture and structures, as well as related systems and devices for the same. In one implementation, a modular building device for use in building a modular structure is disclosed. The modular building device can include a plurality of support panels. Each of the plurality of support panels can include a rigid body comprising a plurality of surfaces including an outer surface and an inner surface. The rigid body can further include a central region forming an inner portion of the rigid body. The rigid body can further include an edge region formed around the central region. The rigid body can further include a panel edge bounding the edge region and defining the outer surface and the inner surface of the rigid body, the rigid body defining one or more receiving ports with a receiving shape in the edge region, one or more receiving ports being positioned at the edge region. The rigid body can further include a fastener connecting hole formed in the central region, the fastener connecting hole being aligned between each of the plurality of support panels. The modular building device can further include a fastener connecting each of the plurality of support panels through the fastener connecting hole, the fastener connecting the plurality of support panels in a substantially perpendicular fashion.

In another implementation, a modular building device for use in building a modular structure is disclosed. The modular building device can include a plurality of support panels. The plurality of support panels can include a rigid body having an outer surface and an inner surface, the outer surface being opposite the inner surface, the rigid body defining a plurality of receiving ports. The plurality of support panels can further include a fastener connecting element configured to receive a fastener, the fastener configured to connect the plurality of support panels substantially perpendicular to one another using the fastener connecting element. The modular building device can further include a connecting member. The connecting member can have a connection body. The connecting member can further have a first arm extending from the connection body in a first direction. The connecting member can further have a second arm extending from the connection body in a second direction. The connecting member can further have the connection body connecting with and separating the first arm and the second arm, the connection body being configured to position the first arm in the first direction and second arm in a second direction, the first arm and the second arm having an interconnecting extension, the interconnecting extension from the first arm configured to connect to the receiving ports of the plurality of support panels.

In another implementation, a modular structure is disclosed. The modular structure can include a plurality of modular building devices, each modular building device comprising a plurality of support panels, at least one of the plurality of support panels having one or more receiving holes, the plurality of support panels being connected with a fastener and forming a stack. The modular structure can further include a plurality of connecting members, the plurality of connecting members comprising one or more interconnecting extensions, the plurality of connecting members being positioned between the support panels of the modular building devices, the interconnecting extensions connecting to the one or more receiving holes, the plurality of connecting members connected between the modular building devices in an alternating fashion to create one or more surfaces.

BRIEF DESCRIPTION OF THE DRAWINGS

So that the manner in which the above-recited features of the present disclosure can be understood in detail, a more particular description of the disclosure, briefly summarized above, may be had by reference to the implementations, some of which are illustrated in the appended drawings. It is to be noted, however, that the appended drawings illustrate only some implementations of this disclosure and are therefore not to be considered limiting of its scope. The disclosure may admit to other equally effective implementations.

To facilitate understanding, identical reference numerals have been used, wherever possible, to designate identical elements that are common to the figures. Additionally, elements of one implementation may be advantageously adapted for utilization in other implementations described herein.

DETAILED DESCRIPTION

Figure 1:
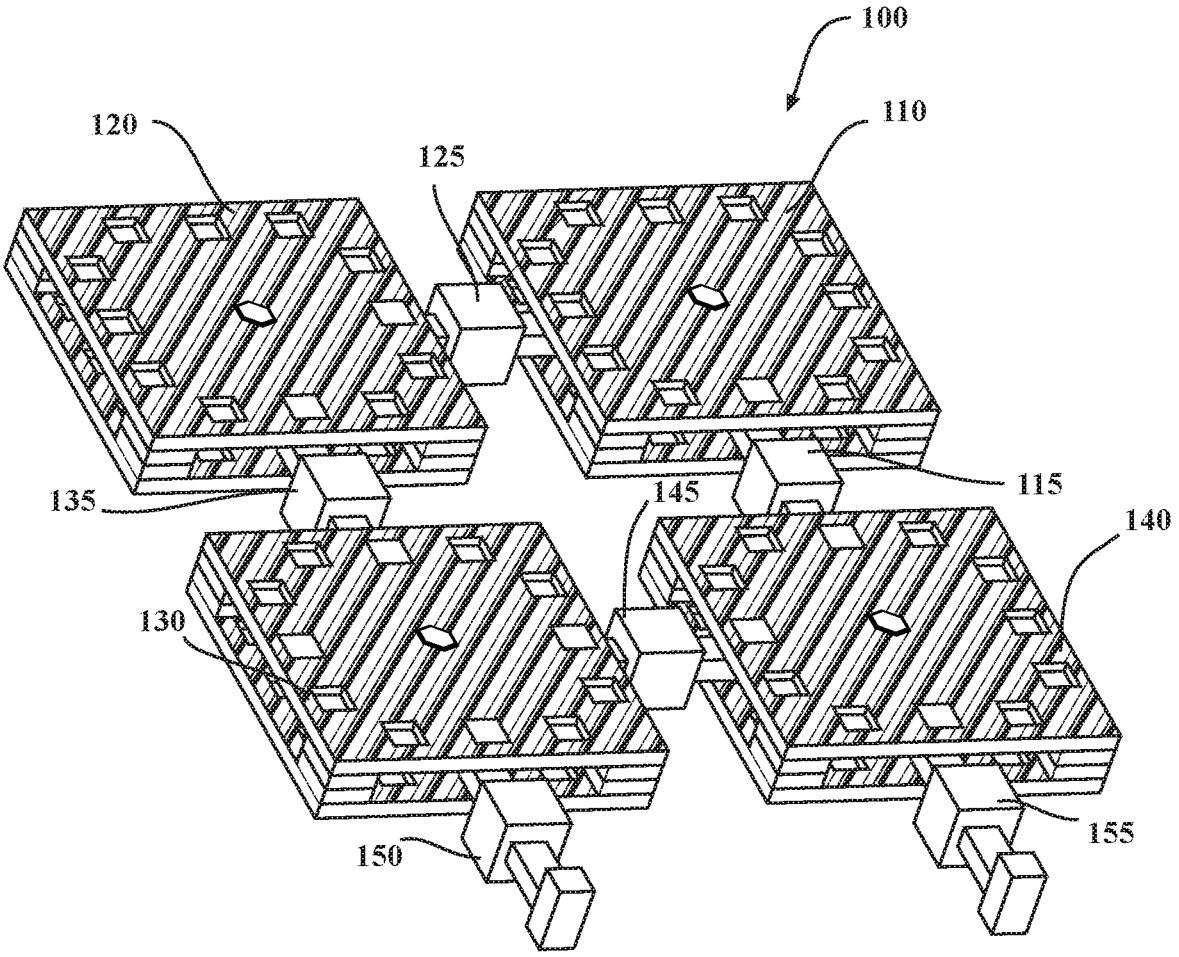
FIG. 1 is an isometric view of the modular structure, according to one or more implementations.

The implementations disclosed herein generally relate to a modular building device for building a variety of objects and methods of using the same. The modular device can include one or more surface panels, one or more support panels, one or more connecting members (also referred to as "bones") and one or more fasteners. Support panels provide a frame for the connection to the connecting members, fasteners and surface panels. The support panels can include one or more receiving ports. The receiving ports can be used for connection with the connecting members. In one or more implementations, the receiving ports can be configured to receive the one or more connecting members at a specific angle or direction, such that the one or more connecting members maintain a specific alignment with respect to the one or more support panels.

Surface panels, according to one or more implementations herein, can be a type of support panel that is configured to create a substantially flat surface. As used herein, the term "substantially" includes exactly the term it modifies and slight variations therefrom. Thus, the term "substantially similar" means exactly the same and slight variations therefrom. In this particular example, slight variations therefrom can include within normal manufacturing tolerances, within about 10 degrees/percent or less, within about 5 degrees/percent or less, within about 4 degrees/percent or less, within about 3 degrees/percent or less, within about 2 degrees/percent or less, or within about 1 degrees/percent or less.

According to one or more implementations, the surface panels can be substantially similar to the support panels, including having one or more fastener openings and/or one or more receiving ports. As such, the one or more surface panels can receive and support one or more connecting members and/or one or more fasteners. In one or more implementations, surface panels with support panels to present a flat surface. Further, it is understood that surface panels are a type of support panel and incorporate the functionality of support panels. As such, surface panels and/or support panels can be used interchangeably, in one or more of the implementations described or taught throughout the specification.

Connecting members operatively connect the surface panels and support panels. In some implementations, the connecting members form a lateral connection. Through these connections, the connecting members can allow for connections and angles between panels, as well as relative mobility between said components. The support panels and/or the surface panels can include one or more receiving ports which receive and affix at least a portion of the connecting member, such as an affixing element. The affixing element can be a protrusion or extension from the connecting member configured to connect with one or more receiving ports. The affixing element can be a corresponding shape to the shape of the receiving port, such as a square-shaped receiving port and a square-shaped affixing element.

As used herein, the terms "operatively connected" and/or "operative connection" generally refer to any form of connection or association capable of being formed between two or more elements, in light of the functions and/or operations described in the implementations disclosed herein. In one or more implementations, "operatively connected" can include any form of direct and indirect connections, including connections without direct physical contact. Elements which are described herein as "operatively connected" can, in one or more implementations, be more specifically described as "directly connected", "indirectly connected", "connected", "fluidly connected", "mechanically connected", "electrically connected", "fixably connected", "transiently connected", other forms of connection, or combinations of the above connections, as appropriate for the elements being described. In further implementations, prepositions such as "to," "with," "between," "in parallel," "in series," or combinations thereof, can be added to more clearly describe the organization of the operative connections described herein or exchanged to discuss alternative implementations. Furthermore, "operatively connected" can include unitary physical structures, that is, structures formed from a single piece of material (e.g., by casting, stamping, machining, three-dimensional printing, etc.). All permutations of operative connections described here are expressly contemplated for one or more implementations of this disclosure without further explicit recitation herein.

The modular device can begin with at least two of the elements operatively connected together. The elements can be selected from the group consisting of the surface panel(s), support panel, and connecting member(s). The elements can be operatively connected using a fastener. In some implementations, the connecting member is "sandwiched" between two support panels, two surface panels, or combinations thereof. The affixing elements can be positioned in pairs, such that the support panels and/or the surface panels receive a corresponding affixing element when compressed or "sandwiched" on the connecting member. Further, a compressing element can have two or more sets of affixing elements, such that a plurality of support panels and/or the surface panels may be attached to create continuous structures as desired. The implementations disclosed herein are more clearly described with reference to the figures below.

FIG. 1 is an isometric view of a modular structure 100 as assembled from a plurality of modular building devices, according to some implementations. A plurality of the modular building devices, such as a first modular building device 110, a second modular building device 120, a third modular building device 130, and a fourth modular building device 140, can be combined to produce the modular structure 100. The modular structure 100 can include the modular building devices in any order or formation, such that the modular structure 100 performs the functions desired by the user. The first modular building device 110, the second modular building device 120, the third modular building device 130, and the fourth modular building device 140, are depicted here as operatively connected using a first connecting member 115, a second connecting member 125, a third connecting member 135, and a fourth connecting member 145. A fifth connecting member 150 and a sixth connecting member 155 can extend outward from the third modular building device 130 and the fourth modular building device 140 are.

The modular structure 100 is shown here in a surface formation. However, it is understood that the modular structure 100 can take any formation as desired by the user. The modular structure 100 is depicted here as operatively connecting between the first modular building device 110, the second modular building device 120, the third modular building device 130, and the fourth modular building device 140 at about 180° angles (e.g., also referred to as coplanar). In further implementations, the modular structure 100 can be operatively connected in any angle between the first modular building device 110, the second modular building device 120, the third modular building device 130, and the fourth modular building device 140, such that the modular building devices do not occupy the same physical space. Stated another way, the first modular building device 110, the second modular building device 120, the third modular building device 130, and the fourth modular building device 140 can be operatively connected such that the surfaces are coplanar, perpendicular, parallel, or any angle in between. By allowing for a variety of angles between the modular building devices 110, 120, 130, and 140, the modular structure 100 can take any desired shape that the user wishes.

In further implementations, the modular structure 100 can include the modular building devices 110, 120, 130, and 140 being operatively connected to allow relative mobility, such as with six (6) degrees of freedom with respect to one another. The six degrees of freedom, as used here, are defined as movement and rotation in relation to a three-dimensional plane. Described with reference to a single object having a known starting position and direction, movement backwards and forwards (referred to as "surge"), left or right (referred to as "sway"), and up or down (referred to as "heave"), corresponds to movement on Z, X, and Y planes respectively. Yaw is rotation about the Y plane. Pitch is rotation about the X plane. Roll is rotation about the Z plane. As such, the variance factor can be calculated alongside the relative surge, sway, heave, yaw, pitch, and roll, of the vehicle, as appropriate.

The position and orientation of the first modular building device 110, the second modular building device 120, the third modular building device 130, and the fourth modular building device 140, with respect to one another, are generally established by the connecting members which operatively connect them. Examples of connecting members which can form said operative connections can include the first connecting member 115, the second connecting member 125, the third connecting member 135, and/or the fourth connecting member 145. The shape of the first connecting member 115, the second connecting member 125, the third connecting member 135, and the fourth connecting member 145 can control the position and orientation that each of these connecting members connect with the first modular building device 110, the second modular building device 120, the third modular building device 130, and the fourth modular building device 140. Stated another way, the first connecting member 115, the second connecting member 125, the third connecting member 135, and the fourth connecting member 145 can be shaped such that they receive the first modular building device 110, the second modular building device 120, the third modular building device 130, and the fourth modular building device 140 at different positions and orientations in three (3)-dimensional space. As such, the first connecting member 115 the second connecting member 125 the third connecting member 135, and the fourth connecting member 145 can have a variety of angles, planar shifts, or combinations thereof between the elements of the connecting members.

As such, there are a variety of positions and orientations that the modular building devices can take with respect to one another. The variety of positions and orientations of the modular building devices can be guided by the connecting member(s) positioned between them. Using the first modular building device 110 and the second modular building device 120 as an example, the first modular building device 110 can be shifted to a higher or lower position than the second modular building device 120 while maintaining the same orientation. In some implementations, a change in surge, sway, or heave of the first modular building device 110 can occur without changing the yaw, pitch, or roll of the first modular building device 110. In further implementations, the first modular building device 110 can change orientation with respect to a central axis while maintaining the same position with respect to the second modular building device 120. In some examples, a change in the yaw, pitch, and/or roll of the first modular building device 110 can occur while the central axis maintains the same position on the X, Y, and Z coordinate planes. In yet further implementations, the first modular building device 110 can change any combination of the elements of the position and the orientation with respect to the second modular building device 120.

As will be understood herein, the modular building devices and the connecting members can be operatively connected in a variety of ways to create a limitless number of structures. The design of the modular building devices and the connecting members allows the devices to be connected interchangeably, including a variety of angles and positions. As such, the modular structures 100 can serve a variety of roles and as a variety of structural elements in any conceivable location.

Figure 2:
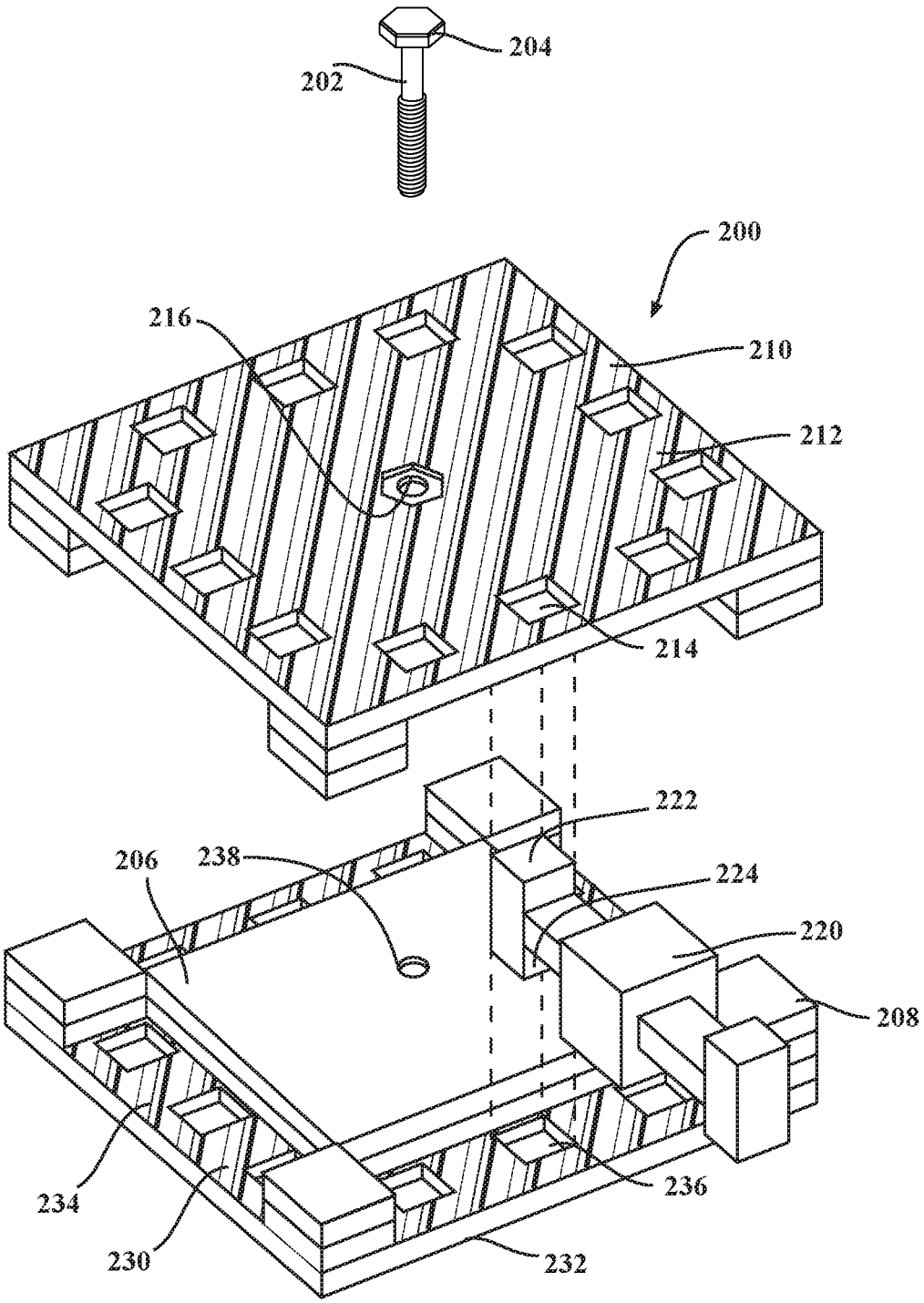
FIG. 2 is a disassembled isometric view of the modular building device, according to one or more implementations.

FIG. 2 is a disassembled isometric view of the modular building device 200, according to one or more implementations. The modular building device 200 is shown in a disassembled state, with a fastener 202 with a head 204, one or more central spacer 206, one or more peripheral spacer 208. The fastener 202, the central spacer 206, and the peripheral spacer 208 can be positioned as part of or otherwise in operative connection with a first support panel 210, a connecting member 220, and/or a second support panel 230. The first support panel 210 can be positioned visually above the connecting member 220 and the second support panel 230. The first support panel 210, the connecting member 220, and the second support panel 230 can be oriented and arranged such that the first support panel 210, the connecting member 220, and the second support panel 230 form a single unit. The first support panel 210, the connecting member 220, and the second support panel 230, in conjunction with the fastener 202, the central spacer 206, and the peripheral spacer 208 can be interlocking and/or immobile, with respect to one another, when formed into a single unit. Terms such as above, below, or other terms which indicate directionality are used for descriptive purposes only. Objects and/or elements shown herein can be located in any position and/or in any orientation, such that the systems and devices described herein can be used, formed and/or function for their intended purpose. The directionality as indicated at one or more points throughout the specification is not intended to be limiting.

The first support panel 210 is a support panel configured to interact with one or more elements as part of the modular building device 200. As shown here, the first support panel 210 can have a generally square shape. The first support panel 210 can be of a variety of shapes including all primary shapes and/or combinations thereof. The first support panel 210 can include a variety of diameters, with, lengths, and heights such that the first support panel 210 can perform one or more support functions as part of the modular building device 200. Support functions, as used herein, generally refer to controlling the stability, relative position/orientation, or other functions with relation to the integrity of both the individual element as well as the overall integrity of the modular building device 200. In one or more implementations, the first support panel 210 can be described as a surface panel and/or a support panel. The first support panel 210 can have a substantially flat surface, such as first outer surface 212. The first outer surface 212 can be an exposed surface of the first support panel 210. The first support panel 210, as seen from the first outer surface 212, can include one or more first receiving ports 214 and/or the one or more first fastener connection 216 formed therein.

The one or more first receiving ports 214 can be formed partially or completely through the first support panel 210. As shown here, the one or more first receiving ports 214 form a complete passage through the first support panel 210.

The one or more first receiving ports 214 can be configured to receive one or more portions of the connecting member 220. In one or more implementations, the one or more first receiving ports 214 can be configured to create a flat surface in operative connection with the connecting member 220. The one or more first receiving ports 214 can be formed in a variety of shapes, including all primary shapes and/or combinations thereof. Further, the one or more first receiving ports 214 can have different shapes as compared to one another, including the formation of pairs or other groupings within the one or more first receiving ports 214. The pairs or other groupings of the one or more first receiving ports 214 can be based on positioning, orientation, general shape and/or combinations of shape, variations in width/height/depth, angle of penetration, or other facets which can be used to establish a general groupings of any number of the one or more first receiving ports 214.

The one or more first fastener connection 216 can be one or more receiving elements capable of interacting with the fastener 202 to fix or join one or more components of the modular building device 200. Examples of the one or more first fastener connection 216 can include inlets, openings, attachment elements, devices, or components. The one or more first fastener connection 216 can further include elements for engaging the fastener 202. Some examples of engaging elements can include threads for receiving a bolt or screw, an indentation for receiving and holding the fastener 202 in place (e.g., a receiving indentation for the head 204 of the fastener 202), or others which serve to improve the connection between the fastener 202 and the first support panel 210. Further, groups of the one or more first fastener connection 216 can work in conjunction for engaging or otherwise interacting with the fastener 202.

The first support panel 210 can be configured with a number of material characteristics in relation to the expected contact of the first outer surface 212 with the environment. In one or more implementations, the material characteristics of the first support panel 210 generally and/or first outer surface 212 can include resistance to abrasion, resistance to specific chemicals/chemistries, specific friction levels, electrical and/or magnetic conductivity, or others as desired. In one or more implementations, the first support panel 210 can generally be composed of and/or include any combination of one or more materials. The materials usable with one or more implementations of the first support panel 210 can include any material capable of providing some level of rigidity and capable of functioning as a component of one or more of the implementations of the modular building device 200 as described herein. The materials can include metals, polymers, ceramics, natural materials (e.g., wood, stone, etc.), composites, and/or others. The materials can further include combinations of the above materials. The combinations of the above materials can be configured to achieve a specific set of purposes (e.g., ferromagnetism and a rubberized/high friction surface). The combinations of the above materials can include layered combinations, such as vertically layered combinations, horizontally layer combinations, layered combinations with varying angles of the layers, and/or combinations thereof. The combinations can further include interspersed combinations, such as fibers of a first material interspersed through second material (e.g., fiberglass), doped materials, alloys, or others.

The first support panel 210 can further be operatively connected with one or more central spacer 206 and/or one or more peripheral spacer 208. The one or more central spacer 206 can be configured to or capable of maintaining a space between one or more components of the modular building device 200. The one or more central spacer 206 and the one or more peripheral spacer 208 can be substantially similar to one another, such as with regards to general shapes, materials, purpose, function, and others. In one or more implementations, the one or more central spacer 206 can have a variety of shapes, such as any primary shape or combinations thereof. The one or more central spacer 206 and/or the one or more peripheral spacer 208 can be composed and positioned so that they can enhance the contact between the first support panel 210 and the other components of the modular building device 200, such as the connecting member 220 and/or the second support panel 230. Furthermore, the one or more central spacer 206 and the one or more peripheral spacer 208 can include a plurality of the central spacer 206 and/or the peripheral spacer 208 positioned horizontally or vertically across a surface of the first support panel 210.

The connecting member 220 can be operatively connected with the first support panel 210 at one or more points, such as through the first receiving ports 214. The connecting member 220 is a component of the modular building device 200 which can form connections between the support panels and/or surface panels, such as the first support panel 210 and the second support panel 230. The connecting member 220 can connect to the first support panel 210 and the second support panel 230 at the first receiving end 222 and/or the second receiving end 224. The connecting member 220 can be configured to control and maintain the direction and/or position of the support panels and/or the surface panels which form the modular building device 200. In some implementations, the first receiving end 222 of the connecting member 220 can be straight or angled with respect to the second receiving end 224. Described another way, the first receiving end 222 can form a first plane and the second receiving end 224 can form a second plane, wherein the first plane and the second plane can be directly overlaid (e.g., intersecting at all points), intersecting at a specific angle, parallel, or others. Thus, the connecting member 220 can be used to control the various angles and directions that are formed by the first support panel 210 and the second support panel 230 of the modular building device 200. The angles formed using the connecting member 220 can be applied to creating various structures, such as boxes, tables, seating, shelves, tables, or other housing/office/industrial-type implements.

The connecting member 220 can have a number of material characteristics. In one or more implementations, the material characteristics of the connecting member 220 can be substantially similar to those described with reference to the first support panel 210. Thus, in one or more implementations, the connecting member 220 can include metals, polymers, ceramics, natural materials, and others. In further implementations, the materials used in the connecting member 220 can be chosen to achieve a specific purpose, such as texture, friction, magnetism, conductivity (e.g., thermal and or electrical), or other parameters which can provide a benefit for the connecting member 220 as incorporated into the modular building device 200. Though the connecting member 220 has an apparent comparative shape and size with relation to that of the depictions of the first support panel 210 and the second support panel 230, this is not intended to be limiting. The connecting member 220 or any sub-portion thereof can be a variety of sizes and shapes such that the connecting member 220 can perform the functions described herein.

The second support panel 230 can be joined with the first support panel 210 and the connecting member 220. The second support panel 230 and/or portions thereof can be substantially similar to the first support panel 210. In some implementations, the second support panel 230 can include a second outer surface 232, a second inner surface 234, a second receiving ports 236, and a second fastener connection 238. The second outer surface 232 can include one or more elements which are substantially similar to the first outer surface 212, described with reference to the first support panel 210. In further implementations, the second support panel 230 can be configured to receive a second portion of the first receiving end 222 at the second inner surface 234. In one or more implementations, the second support panel 230 can further include one or more elements described with reference to the first support panel 210, such as the one or more central spacer 206 and/or the one or more peripheral spacer 208. It is understood that the central spacer 206 and/or the peripheral spacer 208 are depicted here as stacks of the central spacer 206 and/or the peripheral spacer 208. However, it is not necessary that the central spacer 206 and/or the peripheral spacer 208 be stacked. The central spacer 206 and/or the peripheral spacer 208 can achieve the same or similar results through variation in thickness of a single unit of the central spacer 206 and/or the peripheral spacer 208.

In operation, the first support panel 210 and the second support panel 230 can be joined together using the fastener 202. The connecting member 220 can be sandwiched together between the first support panel 210 and the second support panel 230. The first receiving end 222 of the connecting member 220 can penetrate, or otherwise be affixed to, the first support panel 210 at one of the first receiving ports 214 and the second support panel 230 at one of the second receiving ports 236. By joining together the first support panel 210 and the second support panel 230 using the fastener 202, the connecting member 220 can be firmly affixed as part of the unit formed by the first support panel 210, connecting member 220, and the second support panel 230. Optionally, the central spacer 206 and the peripheral spacer 208 can apply and opposite force to that created by the head 204 between the first support panel 210 and the second support panel 230.

Further, the central spacer 206 and the peripheral spacer 208 can maintain a spacing between the first support panel 210 and the second support panel 230, such as to better control the positioning with reference to the connecting member 220. It is understood that the first support panel 210, the connecting member 220, and the second support panel 230, are elemental units of the modular building device 200. As such, the modular building device 200 can include a plurality of the first support panel 210, a plurality of the connecting member 220, and a plurality of the second support panel 230, wherein the connecting member 220 adjoins between the first support panel 210 and the second support panel 230 to create a variety of structures as desired.

Thus the modular building device 200 can form a number of objects based on the continuous combination of the first support panel 210, the connecting member 220, and the second support panel 230, in light of the variety of implementations of each element and others described herein. As can be understood by one of skill in the art, the modular building device 200, as formed from a plurality of the first support panel 210, the connecting member 220, the second support panel 230, can be combined in a variety of ways. In one or more examples, the modular building device 200 can create numerous objects throughout a household, such as shelves, tables, chairs, sofas, room partitions, and a variety of other objects. Further, the modular building device 200 is not limited to household objects. Further implementations of the modular building device 200 can include any indoor or outdoor location, such as offices, warehouses, decks, sporting venues, dormitories, and/or restaurants. Thus, the modular building device 200 can help eliminate the need for a variety of devices and structures which benefit or convenience daily life in modern society.

Figure 3A:
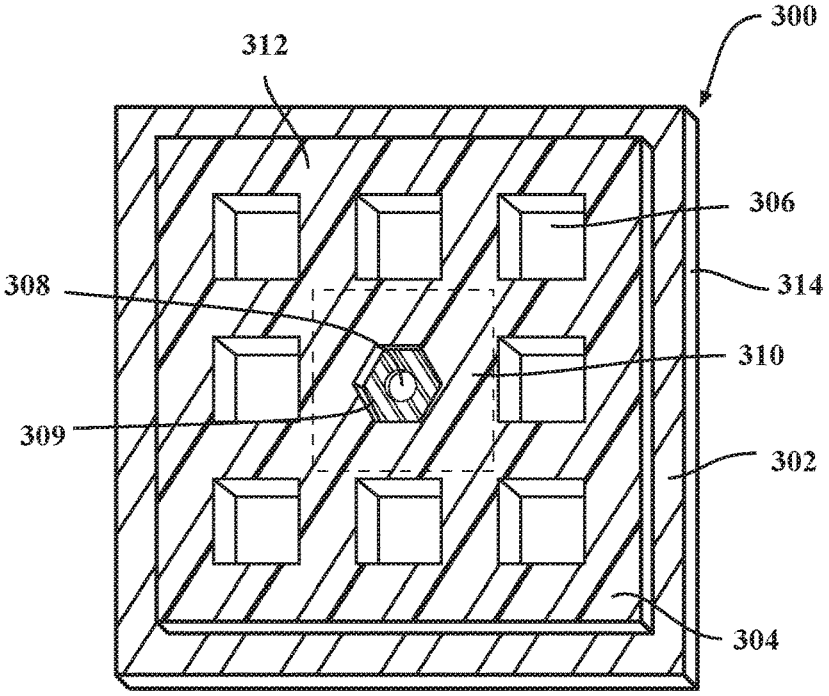
FIGS. 3A and 3B are a front view and a back view of surface panels, according to one or more implementations.
Figure 3B:
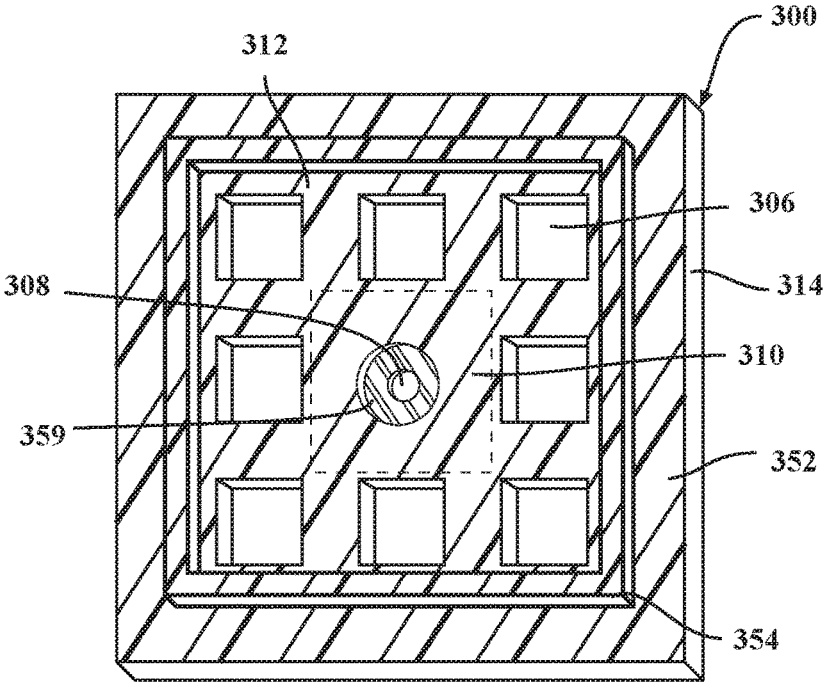

FIGS. 3A and 3B are a front view and a back view of a support panel 300, according to one or more implementations. The support panels, an example of which is the support panel 300, generally form the foundation and structure of the modular building devices described herein. The support panel(s) 300 can connect to one another, with or without spacers, to create a stack or sandwich-like structure. As described above, the support panel 300 can form a modular building device and can connect with one or more connection bodies to form a variety of modular structures.

FIG. 3A depicts the outer side of the support panel 300, according to one or more implementations. In one or more implementations, the outer side of the support panel 300 can generally be the side of the support panel 300 which receives a variety of objects or structures. Objects or structures as used here refer to any number or variety of goods which can come in contact with the modular building devices and or modular structures described herein, such as household, office, warehouse, workshop, or others goods.

The support panel 300 can include a variety of surface structures, such as an outer surface 302, an interconnection element 304, a receiving ports 306, and a fastener connection 308. The outer surface 302 can be the standard surface of the support panel 300 before modification, such as defined by the material or processing technique used in creating the support panel 300. The outer surface 302 can further be modified such that the surface is more suited to the utility of the support panel 300 and of the modular structure overall. Examples of such modifications can include modifying the surface to minimize or maximize surface roughness, adding protective layers to make the surface more resistant to certain chemistries, or others. In this example, the outer surface 302 is generally a flat surface. However, it is understood that a variety of shapes, textures, materials, combinations thereof, and others may be used for the outer surface 302 and the support panel 300 generally.

The outer surface 302 further includes the interconnection element 304. The interconnection element 304 can be positioned on and extend out from the outer surface 302. In one or more implementations, the interconnection element 304 can be configured to connect with, rest on, or otherwise interact with other outer surfaces or other support panels. Through the use of the interconnection element 304, modular structures can be indirectly connected to one another, such as modular building devices operatively connected with connecting members. As such, the interconnection elements 304 can interact or otherwise maintain the desired contact for the modular structures. The interconnection element 304 can be any number of a variety of shapes, shown here as generally the shape of the square and protruding out from the outer surface 302.

The receiving ports 306 is one or more ports which are designed or otherwise configured to interact with the connecting members. The receiving ports 306 is shown here is formed through the interconnection element 304 and the outer surface 302. Further, the receiving ports 306 can have a designated shape such that movement when interacting with the connecting member is minimized. In this example, the receiving ports 306 is shown as having a square shape. However, the receiving ports 306 can have any shape, including all primary shapes and combinations thereof, such that the receiving ports 306 can interact with the connecting member. The receiving ports 306 is shown here is nine ports. In further implementations, the receiving ports 306 can include more or fewer ports.

In further implementations, the receiving ports 306 can be positioned with a variety of spacing, including different spacing between each of the receiving ports 306 and/or spacing between other components of the support panel 300. The support panel 300 can be divided into sections described here as a central region 310, an edge region 312, and a panel edge 314. The central region 310 can be an internal region of the support panel 300 and generally includes the fastener connection 308. The edge region 312 forms an outer boundary around the central region 310 and generally includes the receiving ports 306. The panel edge 314 forms the boundary of both the edge region 312 and the support panel 300 overall. In some examples, the receiving ports 306 can be positioned within the edge region 312. Within the edge region 312, the receiving ports 306 can be closer to the central region 310, closer to the panel edge 314, or combinations thereof (e.g., where some of the receiving ports 306 are positioned closer to the central region 310, while others of the receiving ports 306 are position closer to the panel edge 314 within the edge region 312).

The fastener connection 308 is positioned within the central region 310 of the support panel 300. The fastener connection 308 is configured to receive a fastener, such as the fastener 202 described with reference to FIG. 2. The fastener connection 308 is shown here as having a fastener seat 309. The fastener seat 309 can allow for the head of a fastener to be recessed such that the surface remains flat at the outer surface 302 and/or the interconnection element 304. Though depicted as a single fastener connection 308, it is understood that one or more fastener connection 308 can be used in one or more implementations described herein. The fastener connection 308 can receive a fastener and allow the fastener to pass through to another support panel, as depicted in FIG. 2. In this way, the fastener connection 308 can interact with a fastener to sandwich two support panels together as part of the modular building devices described herein.

FIG. 3B depicts the inner surface 352 of the support panel 300, according to one or more implementations. The inner surface 352 is the side of the support panel 300 which can interact with the equivalent portions of other support panels, including another support panel 300, as described herein. As shown here, the receiving ports 306 extending through from the outer surface 302 to the inner surface 352. As well, represented in this view is the fastener connection 308, the central region 310, the edge region 312, and the panel edge 314. Each of these elements is described with reference to FIG. 3A. In some implementations, the receiving ports 306 can penetrate at an angle with reference to the outer surface 302 and the inner surface 352. In this case, the interconnecting extension of the connecting member would be angled such that said interconnecting member slides into the receiving ports 306 at an angle. This angle would further immobilize the connecting member and make removal from the support panel 300 difficult. As such, the receiving ports 306 can act as a locking mechanism to maintain the connection between one or more connecting members and the support panel 300

The inner surface 352 further includes a spacer element 354. The spacer element 354 can be a region or device of the support panel 300 which maintains proper spacing between the support panel 300 and another surface panel. The spacer element 354 can be any shape or size such that proper spacing is maintained. The spacer element 354 can be designed with consideration of connection with one or more connecting members. As such, the spacer element 354 can be made from different materials, such as compressible materials, which can allow the spacer element 354 to form around a connecting member while maintaining proper spacing between the surface panels and the support panel 300.

The inner surface 352 can further include the spacer connection 359. The spacer connection 359 can be a spacing or recess configured to receive a spacer element or other connection from an opposing surface panel. In some implementations, an opposing surface panel can include one or more spacing elements (not shown) which are configured to interconnect with the spacer connection 359. As such, the spacer connection 359 can both maintain proper spacing and proper positioning between the support panel 300 and the opposing surface panel, such as during a connection event between the two surface panels.

Figure 4A:
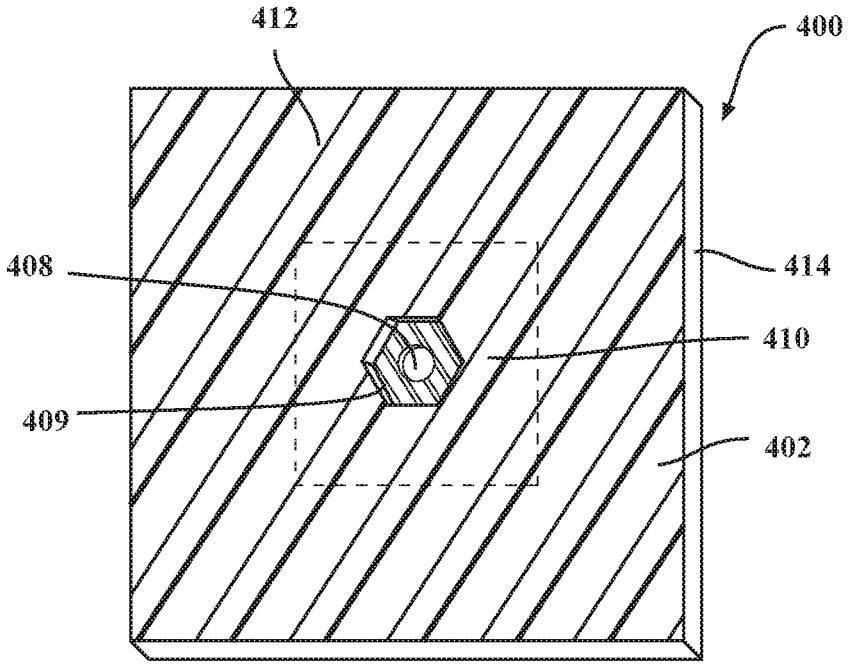
FIGS. 4A and 4B are a front view and a back view of surface panels, according to further implementations described herein.
Figure 4B:
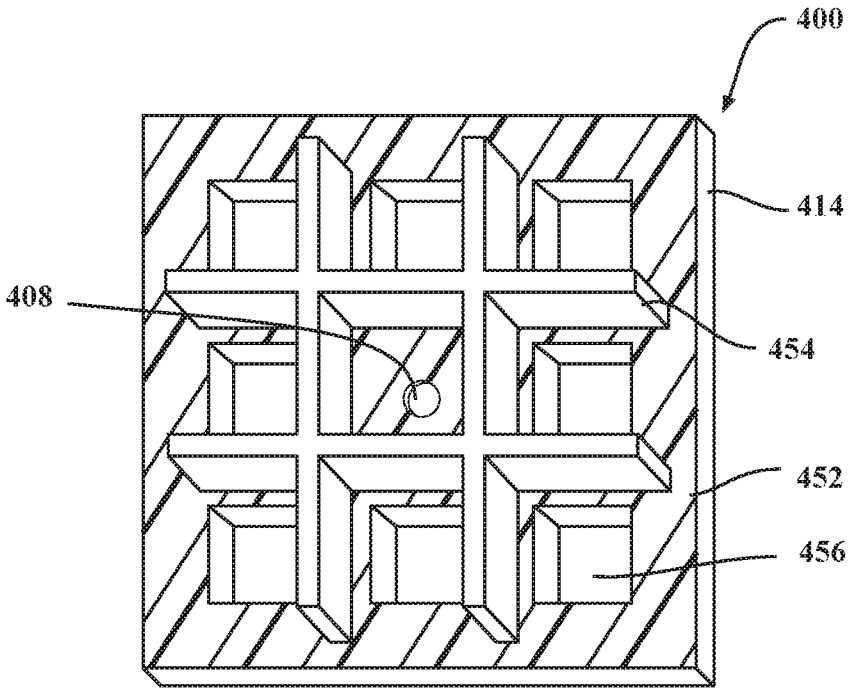

FIGS. 4A and 4B are a front view and a back view of a support panel 400, according to further implementations described herein. FIGS. 4A and 4B are a front view and a back view of a support panel 400, according to one or more implementations. The support panels, an example of which is the support panel 400, generally form the foundation and structure of the modular building devices described herein. The support panel 400 can connect to one another, with or without spacers, to create a stack or sandwich-like structure. As described above, the support panel 400 can form a modular building device and can connect with one or more connection bodies to form a variety of modular structures.

FIG. 4A depicts the outer side of the support panel 400, according to one or more implementations. In one or more implementations, the outer side of the support panel 400 can generally be the side of the support panel 400 which receives a variety of objects or structures. As shown in this implementation, the support panel 400 has a substantially flat outer surface 402. In some implementations, the can be beneficial to have a flat surface, such as for modular device which will be used as a table or shelf. As such, the outer surface 402 has minimal elements to maintain a flat surface as described herein. As above, the outer surface 402 can further be modified such that the surface is more suited to the utility of the support panel 400 and of the modular structure overall. Examples of such modifications can include modifying the surface to minimize or maximize surface roughness, adding protective layers to make the surface more resistant to certain chemistries, or others. In this example, the outer surface 402 is generally a flat surface. However, it is understood that a variety of shapes, textures, materials, combinations thereof, and others may be used for the outer surface 402 and the support panel 400 generally.

Shown here the outer surface 402 has a fastener connection 408. The support panel 400 can be divided into sections described here as a central region 410, an edge region 412, and a panel edge 414. The central region 410, the edge region 412, and the panel edge 414 can be substantially similar to the central region 310, the edge region 312, and the panel edge 314 described with reference to FIG. 3A. The fastener connection 408 is positioned within the central region 410 of the support panel 400. The fastener connection 408 is configured to receive a fastener, such as the fastener 202 described with reference to FIG. 2. The fastener connection 408 is shown here as having a fastener seat 409. The fastener seat 409 can allow for the head of a fastener to be recessed such that the surface remains flat at the outer surface 402. The fastener connection 408 can receive a fastener and allow the fastener to pass through to another support panel, which compresses the two support panels together as part of the modular building devices described herein.

FIG. 4B depicts the inner surface 452 of the support panel 400, according to one or more implementations. The inner surface 452 is the side of the support panel 400 which can interact with the equivalent portions of other support panels, including another support panel 400, as described herein. The inner surface 452 can include a spacer element 454 and a plurality of receiving ports 456. The spacer element 454 can be a region or device of the support panel 400 which maintains proper spacing between the support panel 400 and another surface panel. The spacer element 454 can be any shape or size such that proper spacing is maintained. The spacer element 454 can be designed with consideration of connection with one or more connecting members. As such the spacer element 454 can be made from different materials, such as compressible materials, which can allow the spacer element 454 to form around a connecting member while maintaining proper spacing between the surface panels and the support panel 400.

The receiving ports 456 is one or more ports which are designed or otherwise configured to interact with the connecting members. The receiving ports 456 is shown here is formed into the inner surface 452 and between at least a portion of the spacer element 454. Further, the receiving ports 456 can have a designated shape such that movement when interacting with the connecting member is minimized. In this example, the receiving ports 456 is shown as having a square shape. However, the receiving ports 456 can have any shape, including all primary shapes and combinations thereof, such that the receiving ports 456 can interact with the connecting member. The receiving ports 456 is shown here is nine (9) ports. In further implementations, the receiving ports 456 can include more or fewer ports. In some implementations, the receiving ports 456 can be restricted to the whole number of connections that the support panel 400 is intended or designed to receive.

In further implementations, the receiving ports 456 can be positioned with a variety of spacing, including different spacing between each of the receiving ports 456 and/or spacing between other components of the support panel 400. In some examples, the receiving ports 456 can be positioned within the edge region 412. Within the edge region 412, the receiving ports 456 can be closer to the central region 410, closer to the panel edge 414, or combinations thereof (e.g., where some of the receiving ports 456 are positioned closer to the central region 410 while others of the receiving ports 456 are position closer to the panel edge 414 within the edge region 412). As shown here, the receiving ports 456 extending into the inner surface 452 without penetrating through the outer surface 402.

FIGS. 5A-5D are isometric side views of connecting members, according to one or more implementations. As shown above, one or more elements of the connecting members can interact with and provide direction to the support panels as part of a modular building device. Therefore, the connecting members can form a connection between one or more support panels to form the modular building devices and modular structures respectively.

Figure 5A:
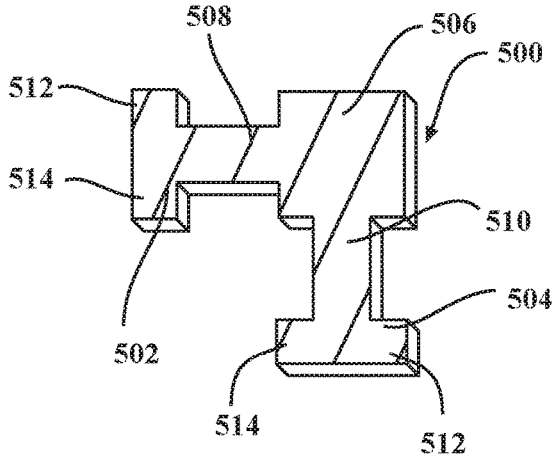
FIGS. 5A and 5D are isometric side views of connecting members, according to one or more implementations.

FIG. 5A depicts an isometric side view of a connecting member 500, according to one or more implementations. The connecting member 500 can generally include a first interconnection element 502, a second interconnection element 504, a connection body 506, a first arm 508, and a second arm 510. The connecting member 500, as shown here, is generally configured to interact with two groups of support panels configured as modular building devices. The connecting member 500 is further configured to position those modular building devices at an angle with respect to one another. The connecting member 500 or components thereof can be composed of a variety of materials. In some implementations, the connecting member 500 or components thereof can be composed of a rigid or semi-rigid material. Examples of materials which can be used for the connecting member 500 can include but are not limited to polymers (e.g., plastics, elastomers, etc.), metals, alloys, stone, natural materials (e.g., wood, natural rubber, etc.), ceramics, combinations thereof, or others. In one or more implementations, the connecting member 500 can be composed of a substantially similar material to those described with reference to support panels in FIGS. 2 and 3.

The connecting member 500 can begin with the connection body 506. The connection body 506 can be the main body of the connecting member 500. The connection body 506 supports the other elements of the connecting member 500, such that the connecting member 500 can maintain the modular building devices in a specific designated position without failing under pressure or stress. The connection body 506 is depicted here as a largely monolithic structure alongside the first interconnection element 502, the second interconnection element 504, the first arm 508, and the second arm 510. However, the connection body 506 can be made from different materials and/or as a different component from the other elements of the connecting member 500. The connection body 506 is depicted here as largely in the shape of a cube. However the connection body 506 can be of any shape or combinations of shapes such that the connection body 506 can perform the functions described herein.

The first arm 508 and the second arm 510 are arms or extensions which extend out from the connection body 506. The first arm 508 and the second arm 510 serve as support structures for the first interconnection element 502 and the second interconnection element 504, respectively, as extending out from the connection body 506. Further, the first arm 508 and the second arm 510 determine the distance between the connection body 506, the second arm 510, and the first interconnection element 502. The first interconnection element 502 and the second interconnection element 504 can be integrally connected with a modular building device. As such, the first arm 508 and the second arm 510, as operatively connected to the first interconnection element 502 and the second interconnection element 504, further create a spacing which sets the distance between the connection body 506 and the other components of the modular building device. The first arm 508 can be composed of a variety of materials, such as those described above with reference to the connecting member 500 generally and/or combinations thereof. The first arm 508 and the second arm 510 can further be substantially similar to one another. In yet further implementations, the first arm 508 can have one or more characteristics, as selected from one or more of the implementations described herein, which differ from the second arm 510.

The connecting member 500 can generally include the first interconnection element 502 and the second interconnection element 504. The first interconnection element 502 and the second interconnection element 504 are the elements of the connecting member 500 which penetrates the receiving ports of a support panel. The first interconnection element 502 and the second interconnection element 504 penetrate the receiving ports using the first receiving member 512 and the second receiving member 514. As such, the first receiving member 512 and the second receiving member 514 can have a substantially similar shape to one or more of the receiving ports. The first interconnection element 502 is depicted here as being generally straight between the first receiving member 512 and the second receiving member 514. However, the first interconnection element 502 can include a variety of shapes as formed between the first receiving member 512 and the second receiving member 514. The shapes of the first interconnection element 502 can provide numerous benefits with regards to the connection between the support panels and preventing the first interconnection element 502 from dislodging from a completed modular building device, as depicted in FIG. 2, and/or a completed modular structure, as depicted in FIG. 1. The first interconnection element 502 and the second interconnection element 504 can further be substantially similar to one another. In yet further implementations, the first interconnection element 502 can have one or more characteristics, as selected from one or more of the implementations described herein, which differ from the second interconnection element 504. As well, the first receiving member 512 and the second receiving member 514 as presented on the first interconnection element 502 may each be substantially similar or different from the first receiving member 512 and the second receiving member 514 as presented on the second interconnection element 504.

As shown in this example, the first arm 508 and the second arm 510 extend from the connection body 506 creating a 90° angle. Though shown as a 90° angle, it is understood that any angle between 0° and 360° can be created between the first arm 508, the second arm 510 and the connection body 506 respectively. As such, the modular building device being operatively connected with the first interconnection element 502 (not shown) can form an angle with the modular building device operatively connected with the second interconnection element 504 (not shown) based on the angle formed between the first arm 508 and the second arm 510 by the connection body 506. The angles formed between the first interconnection element 502 and the second interconnection element 504 can be both with relation to degrees and directionality. In some implementations, the angle formed between the first interconnection element 502 and the second interconnection element 504 can be described both with relation to the angle formed and an angle of rotation based on the orientation of the connecting member 500. Thus the angle formed at the connection body 506 can control the directionality of the modular building device is attached to the connecting member 500 and ultimately the shape of the modular structure.

Figure 5B:
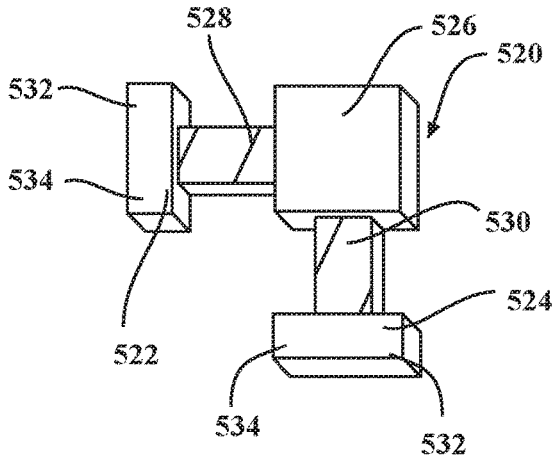

FIG. 5B depicts an isometric side view of a connecting member 520, according to further implementations herein. The connecting member 520 can include a first interconnection element 522, a second interconnection element 524, a connection body 526, a first arm 528, and a second arm 530. The first interconnection element 522 and the second interconnection element 524 can each have a first receiving member 532 and a second receiving member 534. The first interconnection element 522, the second interconnection element 524, the connection body 526, the first arm 528, the second arm 530, the first receiving member 532, and the second receiving member 534 can be substantially similar to the first interconnection element 502, the second interconnection element 504, the connection body 506, the first arm 508, the second arm 510, the first receiving member 512, and the second receiving member 514 respectively.

As shown here, the connection body 526 forms an angle as described above with reference to the connection body 506. Further, in this implementation, the first interconnection element 522, the second interconnection element 524, and the connection body 526 can include an expanded lateral region. The expanded lateral region can increase the resting area for a connected support panel. The resting area is the portion of the first interconnection element 522, the second interconnection element 524 and the connection body 526 upon which the connected support panel rests in relation to the first arm 528 and the second arm 530. As such, the expanded lateral region can increase the stability of an assembled modular building device and the overall modular structure.

Figure 5C:
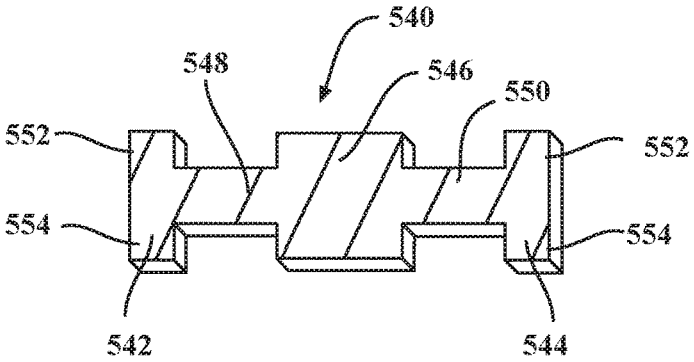

FIG. 5C depicts an isometric side view of a connecting member 540, according to further implementations herein. The connecting member 540 can include a first interconnection element 542, a second interconnection element 544, a connection body 546, a first arm 548, and a second arm 550. The first interconnection element 542 and the second interconnection element 544 can each have a first receiving member 552 and a second receiving member 554. The first interconnection element 542, the second interconnection element 544, the connection body 546, the first arm 548, the second arm 550, the first receiving member 552, and the second receiving member 554 can be substantially similar to the first interconnection element 502, the second interconnection element 504, the connection body 506, the first arm 508, the second arm 510, the first receiving member 512, and the second receiving member 514 respectively. In some implementations, the connection body 546 can extend straight out in both directions. Based on perspective, this angle for the connection body 546 can be referred to either as 180° angle or no angle. By extending out straight in both directions, the connection body 546 can allow for the linear formation of the modular building devices. The linear formation of modular building devices, as operatively connected to the connection body 546, can be used to create a variety of surfaces, walls, or other flat structures.

Figure 5D:
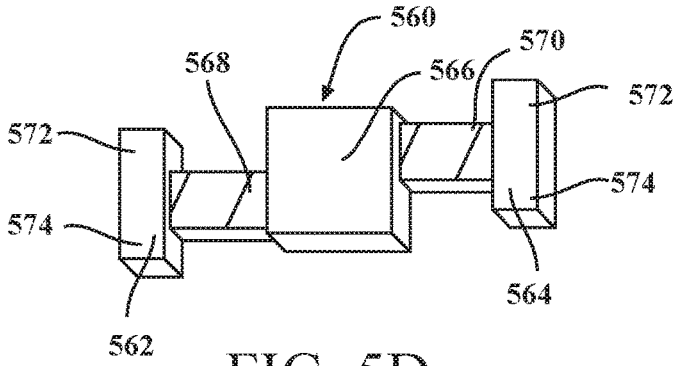

FIG. 5D depicts an isometric side view of a connecting member 560, according to further implementations herein. The connecting member 560 can include a first interconnection element 562, a second interconnection element 564, a connection body 566, a first arm 568, and a second arm 570. The first interconnection element 562 and the second interconnection element 564 can each have a first receiving member 572 and a second receiving member 574. The first interconnection element 562, the second interconnection element 564, the connection body 566, the first arm 568, the second arm 570, the first receiving member 572, and the second receiving member 574 can be substantially similar to the first interconnection element 502, the second interconnection element 504, the connection body 506, the first arm 508, the second arm 510, the first receiving member 512, and the second receiving member 514 respectively.

In this implementation, the connection body 566 is depicted as extending straight out in both directions. Based on perspective, this can be referred to either as 180° angle or no angle. As well, in this implementation, the connection body 566 creates a lateral shift in the second arm 570 and the first arm 568 respectively. In some implementations, the second arm 570 can be moved upward relative to the center. The first arm 568, as shown in this example, can be moved downward relative to the center. By shifting the first arm 568 and the second arm 570, the connecting member 560 further shifts the first interconnection element 562 and the second interconnection element 564 respectively. By extending out straight in both directions, the connection body 566 can allow for the linear tiered formation of the modular building devices. The linear formation of modular building devices, as operatively connected to the connection body 566, can be used to create a variety of offsets to otherwise flat structures.

Further, in this implementation, the first interconnection element 562, the second interconnection element 564, and the connection body 566 can include an expanded lateral region. The expanded lateral region can increase the resting area for a connected support panel. The resting area is the portion of the first interconnection element 562, the second interconnection element 564 and the connection body 566 upon which the connected support panel rests in relation to the first arm 568 and the second arm 570. As such, the expanded lateral region can increase the stability of an assembled modular building device and the overall modular structure.

Thus, the connecting members can provide a variety of levels of control in the positioning of the modular building devices, as disclosed herein. By changing the orientation and position of the first arm and the second arm with respect to the connection body, the first interconnection element and the second interconnection element can be repositioned in space. As shown in the designs herein, the position of the first interconnection element in the position of the second interconnection element controls the overall position of the modular building devices formed from the connected support panels. Further, the connecting members provide reinforcement and support to the connected modular building devices providing desired levels of strength and flexibility to the overall modular structure.

Figure 6:
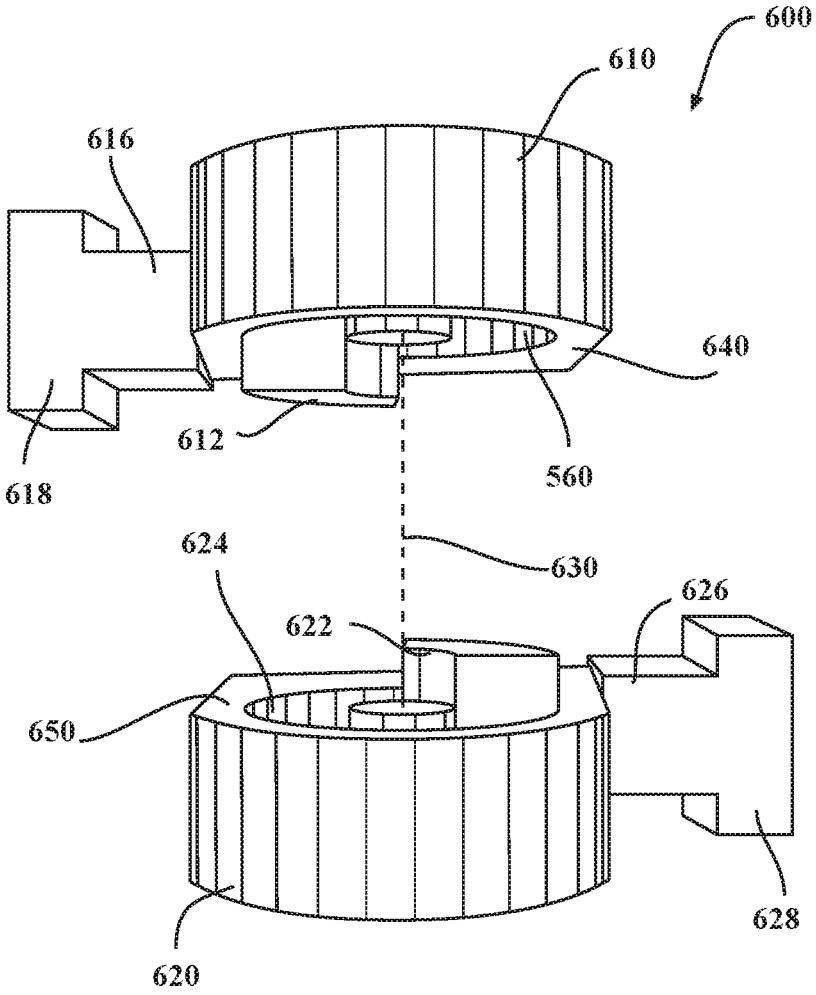
FIG. 6 is a disassembled isometric view of a joint-style connecting member, according to one or more implementations.

FIG. 6 is a disassembled isometric view of a joint-style connecting member 600, according to one or more implementations. The joint-style connecting member 600 includes an upper connection body 610 and a lower connection body 620 which can be operatively connected and/or mobile with respect to one another. As such, when operatively connected with or as part of a modular structure, the upper connection body 610 can move a portion of the modular structure while leaving the remaining portions of the modular structure, as operatively connected to the lower connection body 620, in place. Though the joint-style connecting member 600 is described with reference to upper and lower, directionality or references to directionality are used solely for ease of description. The utility of the joint-style connecting member 600 is not limited to any position.

The description of the joint-style connecting member 600 can begin with the upper connection body 610. The upper connection body 610 is a first element of the joint-style connecting member 600 which forms half of the main body. The upper connection body 610 can include an upper tab 612. The upper tab 612 is a tab or protrusion extending out from the upper connection body 610. The upper connection body 610 can further include an upper receiving canal 614. The upper receiving canal 614 is a recess designed to receive a lower tab 622, an equivalent element to the upper tab 612.

Further, the upper receiving canal 614 can allow a sliding movement to said equivalent element. Opposite the upper connection body 610, is the lower connection body 620. The lower connection body 620 is a second element of the joint-style connecting member 600 which forms the other half of the main body. The lower connection body 620 can include the lower tab 622. The lower tab 622 is a tab or protrusion extending out from, the lower connection body 620. The lower tab 622 can be shaped and formed substantially similar to the upper tab 612. The lower connection body 620 can further include a lower receiving canal 624. The lower receiving canal 624 is a recess designed to receive the upper tab 612.

The upper connection body 610 can further include an upper arm 616. The upper arm 616 is an arm which extends out from the upper connection body 610. The upper arm 616 can be substantially similar to the first arm 508, described with reference to FIG. 5A. Operatively connected with the upper arm 616 is the upper interconnection element 618. The upper interconnection element 618 can be substantially similar to the first interconnection element 522, described with reference to FIG. 5A. Respectively, the lower connection body 620 can further include a lower arm 626 and a lower interconnection element 628. The lower arm 626 and the lower interconnection element 628 can be substantially similar to the second arm 510 and the second interconnection element 524, respectively described with reference to FIG. 5A.

In operation, the upper connection body 610 and the lower connection body 620 can be brought together through the use of a fastener, such as a screw or an interlocking element within the upper receiving canal 614 and/or the lower receiving canal 624. The lower tab 622 will slide in place into the upper receiving canal 614. Respectively the upper tab 612 will slide in place into the lower receiving canal 624. The upper receiving canal 614 and the lower receiving canal 624 both have ample space to allow rotation along a central axis 630. The upper tab 612 can subsequently slide within the lower receiving canal 624, while the lower tab 622 can slide within the upper receiving canal 614, thus allowing rotation around the central axis 630. The upper connection body 610 can further include an upper receiving surface 640, while the lower connection body 620 can further include a lower receiving surface 650. The upper receiving surface 640 and the lower receiving surface 650 can be a surface structure and/or a surface material designed to reduce friction and wear between the upper connection body 610 and the lower connection body 620 during rotation. In some implementations, the upper receiving surface 640 and/or the lower receiving surface 650 are a decreased surface roughness, such as a surface roughness of less than 50% the average roughness of other surfaces on the upper connection body 610 and/or the lower connection body 620. In further implementations, the upper receiving surface 640 and/or the lower receiving surface 650 are a coating designed to decrease adhesion or friction between two surfaces, such as a polytetrafluoroethylene coating or other material.

As such, the joint-style connecting member 600 can provide the additional benefit of movement between two or more modular building devices within a modular structure. The joint-style connecting member 600 can be used to create various mobile elements within the structure, such as doors or other hinged elements. As well, the joint-style connecting member 600 further adds to the adaptability of the system for the modular structures described herein.

In the description above, certain specific details are outlined in order to provide a thorough understanding of various implementations. However, one skilled in the art will understand that the invention may be practiced without these details. In other instances, well-known structures have not been shown or described in detail to avoid unnecessarily obscuring descriptions of the implementations. Unless the context requires otherwise, throughout the specification and claims which follow, the word "comprise" and variations thereof, such as, "comprises" and "comprising" are to be construed in an open, inclusive sense, that is, as "including, but not limited to." Further, headings provided herein are for convenience only and do not interpret the scope or meaning of the claimed invention.

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations. Also, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

Detailed implementations are disclosed herein. However, it is to be understood that the disclosed implementations are intended only as examples. Therefore, specific structural and functional details disclosed herein are not to be interpreted as limiting, but merely as a basis for the claims and as a representative basis for teaching one skilled in the art to variously employ the aspects herein in virtually any appropriately detailed structure. Further, the terms and phrases used herein are not intended to be limiting but rather to provide an understandable description of possible implementations. Various implementations are shown in FIGS. 1-6, but the implementations are not limited to the illustrated structure or application.

The flowcharts and block diagrams in the figures illustrate the architecture, functionality, and operation of possible implementations of systems, methods, devices, and computer program products according to various implementations. In this regard, each block in the flowcharts or block diagrams can represent a module, segment, or portion of code, which can include one or more executable instructions for implementing the specified logical function(s). It should also be noted that, in some alternative implementations, the functions noted in the block can occur out of the order noted in the figures. For example, two blocks shown in succession can, in fact, be executed substantially concurrently, or the blocks can sometimes be executed in the reverse order, depending upon the functionality involved.

The systems, components and/or methods described above can be realized in hardware or a combination of hardware and software and can be realized in a centralized fashion in one processing system or in a distributed fashion where different elements are spread across several interconnected processing systems. Any kind of processing system or other apparatus adapted for carrying out the methods described herein is suited. A typical combination of hardware and software can be a processing system with computer-usable program code that, when being loaded and executed, controls the processing system such that it carries out the methods described herein. The systems, components and/or methods also can be embedded in a computer-readable storage, such as a computer program product or other data programs storage device, readable by a machine, tangibly embodying a program of instructions executable by the machine to perform methods and methods described herein. These elements also can be embedded in an application product which can include all the features enabling the implementation of the methods described herein and, which when loaded in a processing system, is able to carry out these methods.

The headings (such as "Background" and "Summary") and sub-headings used herein are intended only for general organization of topics within the present disclosure and are not intended to limit the disclosure of the technology or any aspect thereof. The recitation of multiple implementations having stated features is not intended to exclude other implementations having additional features, or other implementations incorporating different combinations of the stated features. As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an implementation can or may comprise certain elements or features does not exclude other implementations of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an implementation or particular system is included in at least one implementation or aspect. The appearances of the phrase "in one aspect" (or variations thereof) are not necessarily referring to the same aspect or implementation. It should also be understood that the various method steps discussed herein do not have to be carried out in the same order as depicted, and not each method step is required in each aspect or implementation.

The terms "a" and "an," as used herein, are defined as one as or more than one. The term "plurality," as used herein, is defined as two or more than two. The term "another," as used herein, is defined as at least a second or more. The terms "including" and/or "having," as used herein, are defined as including (i.e., open language). The phrase "at least one of . . . and . . . " as used herein refers to and encompasses any and all possible combinations of one or more of the associated listed items. As an example, the phrase "at least one of A, B and C" includes A only, B only, C only, or any combination thereof (e.g., AB, AC, BC or ABC).

The preceding description of the implementations has been provided for purposes of illustration and description. It is not intended to be exhaustive or to limit the disclosure. Individual elements or features of a particular implementation are generally not limited to that particular implementation, but, where applicable, are interchangeable and can be used in a selected implementation, even if not specifically shown or described. The same may also be varied in many ways. Such variations should not be regarded as a departure from the disclosure, and all such modifications are intended to be included within the scope of the disclosure. While the foregoing is directed to implementations of the disclosed devices, systems, and methods, other and further implementations of the disclosed devices, systems, and methods can be devised without departing from the basic scope thereof. The scope thereof is determined by the claims that follow.

What is claimed is:

1. A modular building device for use in building a modular structure, the modular building device comprising:

a first support panel and a second support panel positioned substantially parallel to one another, each of the first support panel and the second support panel comprising:

a rigid body comprising a plurality of surfaces including an outer surface and an inner surface, the rigid body further comprising:

a central region forming an inner portion of the rigid body;

an edge region formed around the central region; and a panel edge bounding the edge region and defining the outer surface and the inner surface of the rigid body, the rigid body defining one or more receiving ports with a receiving shape in the edge region, the one or more receiving ports being positioned between the central region and the panel edge; and a fastener connecting hole formed in the central region, the fastener connecting hole being aligned between the first support panel and the second support panel;

a connecting member connecting at one of the one or more receiving ports between the first support panel and the second support panel, the connecting member further comprising a connection arm having a connection arm width, the first support panel being separated by the connection arm width from the second support panel; and a fastener connecting the first support panel and the second support panel through the fastener connecting hole, the fastener connecting the first support panel and the second support panel in a substantially perpendicular fashion.

2. The modular building device of claim 1, further comprising one or more spacers between the first support panel and the second support panel.

3. The modular building device of claim 1, wherein the first support panel and the second support panel are a square shape or rectangular shape and wherein the outer surface of the first support panel and the second support panel is substantially uniform.

4. The modular building device of claim 1, wherein the connecting member further comprises:

a connection body;

the connection arm of the connecting member comprising a first arm extending from the connection body in a first direction; and a second arm extending from the connection body in a second direction, wherein the connection body forms an angle between 0 degrees and 360 degrees, the angle causing the first direction to be different from the second direction, the first arm and the second arm having an interconnecting extension, the interconnecting extension having a connection shape for connecting to the first support panel and the second support panel, the connection shape being substantially similar to the receiving shape.

5. The modular building device of claim 4, wherein the first arm and the second arm form a 90 degree angle.

6. The modular building device of claim 4, wherein the first support panel comprises a first composition and the connecting member comprises a second composition, the first composition being more rigid than the second composition.

7. The modular building device of claim 1, wherein the outer surface of each support panel is a substantially flat surface.

8. The modular building device of claim 1, wherein the modular building device comprises a stack of three or more spacers positioned between the first support panel and the second support panel, the stack of spacers creating a space equal to the connection arm width.

9. A modular building device for use in building a modular structure, the modular building device comprising:

a first support panel and a second support panel positioned substantially parallel to one another, each of the first support panel and the second support panel comprising:

a rigid body having an outer surface and an inner surface, the outer surface being opposite the inner surface, the rigid body defining a plurality of receiving ports; and a fastener connecting element configured to receive a fastener, the fastener configured to connect the first support panel and the second support panel in operative connection with the fastener connecting element; and a connecting member connecting at one of the one or more receiving ports between the first support panel and the second support panel, the connecting member comprising:

a connection body;

a first arm extending from the connection body in a first direction, the first arm comprising of a width, the first support panel being separated by the first arm width from the second support panel; and a second arm extending from the connection body in a second direction, wherein the connection body connects with and separates the first arm and the second arm, the connection body being configured to position the first arm in the first direction and the second arm in the second direction, the first arm and the second arm having an interconnecting extension, the interconnecting extension from the first arm configured to connect to the receiving ports of the first support panel and the second support panel.

10. The modular building device of claim 9, further comprising one or more spacers between the first support panel and the second support panel.

11. The modular building device of claim 9, wherein each of the first support panel and the second support panel are a square shape or rectangular shape and wherein the outer surface of the first support panel and the second support panel is substantially uniform.

12. The modular building device of claim 9, wherein the first arm and the second arm form a 90 degree angle.

13. The modular building device of claim 9, wherein the first support panel comprises a first composition and the connecting member comprises a second composition, the first composition being more rigid than the second composition.

14. The modular building device of claim 9, wherein the outer surface of each support panel is a substantially flat surface.

15. The modular building device of claim 9, wherein the modular building device comprises a stack of three or more spacers positioned between the first support panel and the second support panel, the stack of spacers creating a space equal to the first arm width.

16. A modular structure, comprising:

a plurality of modular building devices, each modular building device comprising a first support panel and a second support panel connected substantially parallel with one another, the first support panel and the second support panel having one or more receiving holes, the first support panel and the second support panel being connected with a fastener and forming a stack; and a plurality of connecting members each of the plurality of connecting members being positioned between the first support panel and the second support panel of respective modular building devices, the plurality of connecting members connected at one of the one or more receiving holes between the first support panel and the second support panel of respective modular building devices in an alternating fashion to create one or more surfaces, wherein each of the connecting members comprise a connecting arm having a connecting arm width, the first support panel and the second support panel of each respective modular building device being separated from each other by a space, the space being substantially equal to the connecting arm width.

17. The modular structure of claim 16, wherein each of the first support panel and the second support panel further comprise:

a rigid body comprising a plurality of surfaces including an outer surface and an inner surface, the rigid body further comprising:

a central region forming an inner portion of the rigid body;

an edge region formed around the central region; and a panel edge bounding the edge region and defining the outer surface and the inner surface of the rigid body, the rigid body defining the one or more receiving holes with a receiving shape in the edge region, the one or more receiving holes being positioned between the central region and the panel edge; and a fastener connecting hole formed in the central region, the fastener connecting hole being aligned between the first support panel and the second support panel; and the fastener connecting the first support panel and the second support panel through the fastener connecting hole, the fastener connecting the first support panel and the second support panel in a substantially parallel fashion.

18. The modular structure of claim 17, wherein each of the plurality of connecting members further comprise:

a connection body;

each connection arm comprising a first arm extending from the connection body in a first direction; and a second arm extending from the connection body in a second direction, wherein the connection body forms an angle between 0 degrees and 360 degrees, the angle causing the first direction to be different from the second direction, the first arm and the second arm having an interconnecting extension, the interconnecting extension having a connection shape for connecting to the first support panel and the second support panel, the connection shape being substantially similar to the receiving shape.

* * * * *